United States Patent [19]

Cowles et al.

[11] 3,935,497

[45] Jan. 27, 1976

[54] SHADOW MASK THERMAL COMPENSATING ASSEMBLY

[75] Inventors: Richard H. Cowles, Elmhurst; Thomas P. De Franco, Norridge; Roy Maskell, Oak Park, all of Ill.

[73] Assignee: Admiral Corporation, Chicago, Ill.

[22] Filed: July 5, 1968

[21] Appl. No.: 742,651

[52] U.S. Cl. ..... 313/405; 313/407

[51] Int. Cl.[2] ..... H01J 29/07; H01J 31/20; H01J 29/02

[58] Field of Search..... 313/85 S, 92 B, 405, 406, 313/408, 407, 404, 402

[56] References Cited

UNITED STATES PATENTS

| | | | |
|---|---|---|---|
| 3,330,980 | 7/1967 | Shrader | 313/85 S |
| 3,449,611 | 6/1969 | Schwartz et al. | 313/85 S |
| 3,492,522 | 1/1970 | Pappadis | 313/85 S |

*Primary Examiner*—Robert Segal

[57] ABSTRACT

Three substantially L-shaped bimetallic brackets accurately secured to the frame of a color television picture tube undergo corrective flexures in response to temperature variations. These flexures compensate for the thermal expansion of the shadow mask by maintaining the mask in proper alignment between the glass panel and the electron source over the operating temperature range of the picture tube.

6 Claims, 6 Drawing Figures

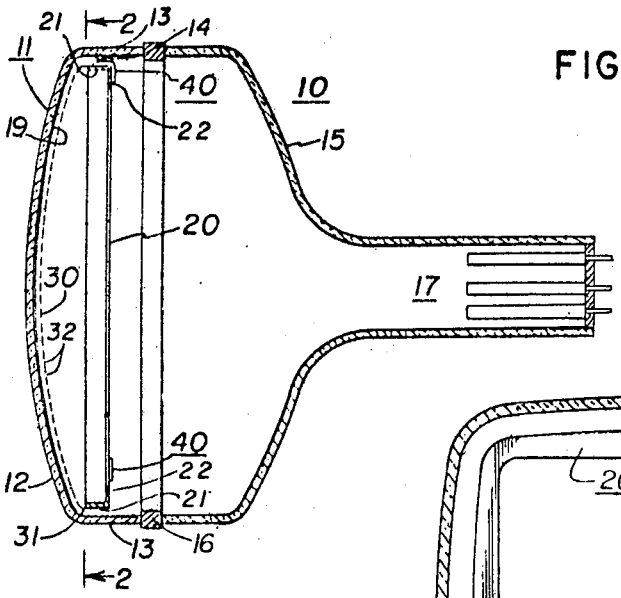
FIG. 1
FIG. 3
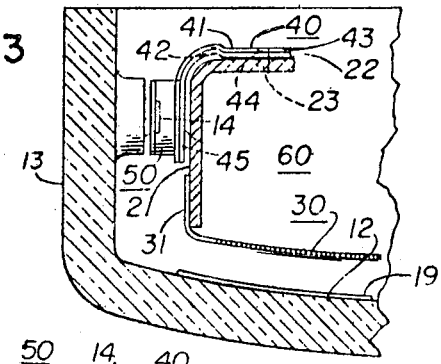
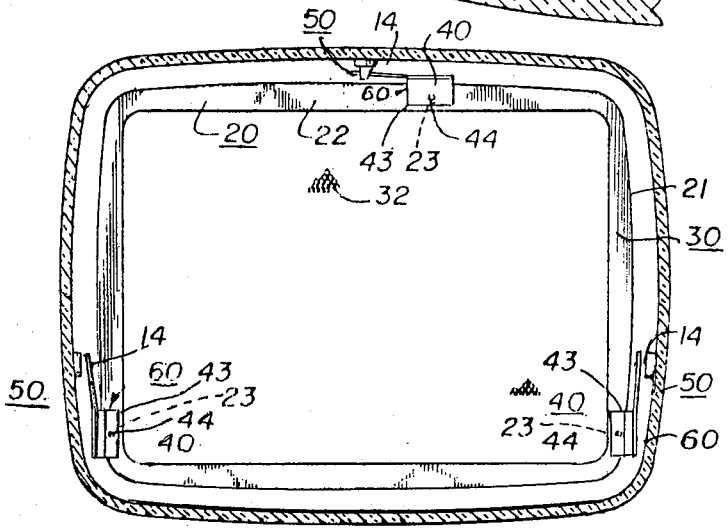
FIG. 2
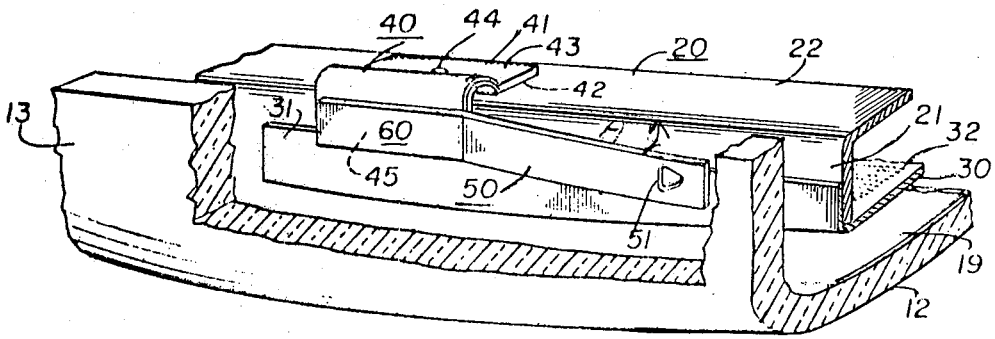
FIG. 4

SHADOW MASK THERMAL COMPENSATING ASSEMBLY

This invention relates to color television picture tubes of the type utilizing a shadow mask through which beams of electrons pass before striking a mosaic of corresponding color phosphors. In particular, this invention provides thermal compensation means for maintaining the shadow mask in accurate alignment between the electron source and the color phosphors over the operating temperature range of the picture tube.

In picture tubes of the type described, three mounting studs are triangularly disposed about the sidewalls of a glass panel. A metal frame, supporting a multi-apertured shadow mask, is releasably secured to the panel by three apertured leaf springs which cooperate with the mounting studs. A mosaic of red, blue and green color phosphors is deposited on the interior of the glass panel in accordance with conventional "light-house" techniques, using the detachable mask for exposing appropriate portions of the panel to sensitizing light rays.

A tri-gun electron source is mounted in the neck of a tapered glass envelope which is frit sealed to the glass panel. Each electron gun is carefully positioned with respect to the shadow mask, such that electrons passing through the apertures impinge only corresponding color phosphors. For example, electrons emanating from the first gun strike only the red phosphors, electrons from the second gun strike only the blue phosphors, etc. During picture tube operation, as many as 85% of the electrons are intercepted by the shadow mask. As the kinetic energy of these electrons is transformed into heat, the picture tube components, and the shadow mask in particular, undergo considerable thermal expansion. Upon expansion, alignment between the electron beams and the corresponding color phosphors is upset, and as a result, electrons emanating from the first gun may, for example, partially impinge the blue or the green phosphors causing substantial color impurities.

This misregistration is readily explained quantitatively. In 23 inch picture tubes, for example, the diameters of the color phosphors at a 10 inch radius from the tube's geometric center are approximately 0.017 inches. The diameters of the landing spots, i.e. the areas defined by the electron beams which strike the glass panel, are about 0.013 inches. Due to inherent errors in manufacture, these beams rarely land concentrically with the phosphors, and as a result, radial misregistration of 0.001 inches is not uncommon. If the beams are displaced an additional 0.001 inches, however, the electrons may excite adjacent phophors and color impurities may result. Since the thermal expansion of the shadow mask causes beam landings that are over 0.003 inches in error, excitation of adjacent phosphors and resulting color misregistration often occurs.

One prior art structure corrects for misregistration due to the effects of mask movement with temperature change by utilizing a plurality of bimetallic expansion brackets secured between the slightly curved sides of the frame and the leaf springs. These brackets undergo corrective flexures in response to increases in temperature which produce forces for moving the frame closer to the glass panel, thereby realigning the shadow mask.

It is desirable that the expansion brackets undergo uniform flexures in response to variations in temperature. Accordingly, Applicants have designed a thermal compensating system utilizing three relatively simple L-shaped bimetallic expansion brackets interposed between the leaf springs and the frame. The frame has a flat top surface to which the brackets are mounted. Accurate location of the brackets is assured independently of frame dimension variations by providing precisely positioned locating holes in the top surface thereof and corresponding locating holes in the brackets. As will be seen hereafter, the arrangement of the invention also automatically compensates for nonuniformities in the springs to assure equal loading thereon.

Accordingly, the primary object of this invention is to provide an improved color television picture tube.

Another object of this invention is to provide, in a color picture tube, improved thermal compensating means for maintaining the shadow mask in accurate alignment between the electron source and the color phosphors.

A further object of this invention is to provide an improved method for accurately locating and securing thermal compensating means to the shadow mask supporting frame of a color television picture tube.

A further object of this invention is to provide improved means for accurately locating and securing the mask-frame assembly to the glass panel in a color picture tube.

A feature of this invention resides in means for positioning the expansion brackets on the shadow mask supporting frame of a color picture tube such that the leaf springs are accurately aligned with the corresponding mounting studs, notwithstanding variations in leaf spring configurations.

Other objects, features and advantages will be gained upon reading the following description in conjunction with the accompanying drawings in which:

FIG. 1 is a sectional view of a color television picture tube incorporating the invention.

FIG. 2 is a sectional view taken along line 2—2 of the color television picture tube shown in FIG. 1.

FIG. 3 is an enlarged cutaway view of a portion of the picture tube of FIG. 1, showing a mask-frame assembly support.

FIG. 4 is an enlarged cutaway view of a portion of the picture tube of FIG. 2, showing the mask-frame assembly support in perspective.

Figure 6:
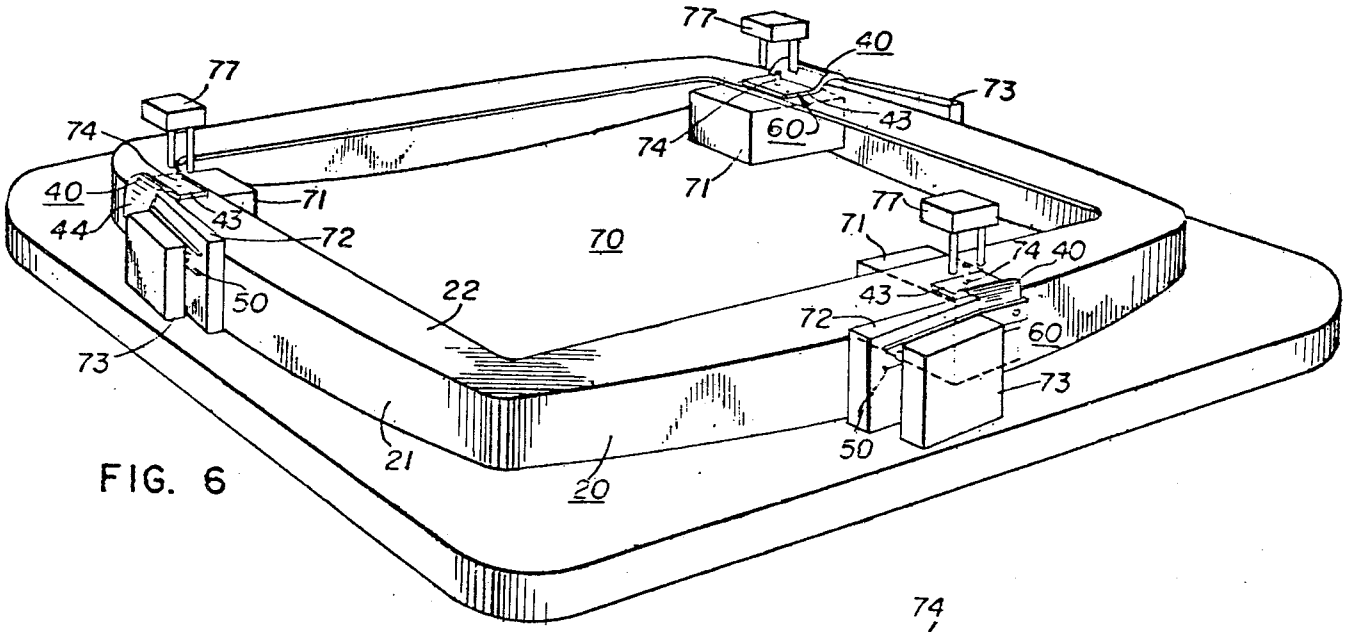
FIG. 6 is a perspective view of the assembly apparatus shown in FIG. 5 with the shadow mask frame and the expansion brackets in position for welding.

Referring now to FIG. 1, a color television picture tube 10 includes a glass panel 11, having a faceplate 12 and a sidewall 13 extending rearwardly from the periphery of the faceplate. Faceplate 12 is approximately rectangular and has a spherical contour on which a mosaic 19 of red, blue and green color phosphors is deposited. Three truncated conical mounting studs 14 (best seen in FIG. 2), accurately disposed about the interior of sidewall 13 of glass panel 11, are embedded or otherwise permanently secured thereto. A shadow mask 30, secured to a frame 20, has a spherical contour similar in shape to faceplate 12. Frame 20 has an L-shaped cross section comprising sidewalls 21 and a flat, top surface 22. As explained in the description of FIG. 2, the frame 20 is releasably secured to faceplate 12 at mounting studs 14.

A glass funnel 15, including a neck portion having three electron guns 17 mounted therein, is secured to glass panel 11 by a conventional frit seal 16. The electron guns are mechanically prealigned such that electrons emanating therefrom strike corresponding ones of the different color phosphors forming mosaic 19, color selection being performed by the well-known masking effect of the shadow mask.

Referring now to FIG. 2, three subassemblies 60, a side view of one being shown in FIG. 3, each comprise a leaf spring 50 fastened at one end to an L-shaped expansion bracket 40. Expansion bracket 40 includes a horizontal leg 43, having a locating hole 44, and a vertical leg 45 (best seen in FIG. 3). Top surface 22 of frame 20 includes three locating holes 23, and as explained later, expansion brackets 40 are welded to the frame with locating holes 44 overlying corresponding ones of locating holes 23. As best seen in FIG. 4, the free ends of leaf springs 50 each include a substantially triangular hole 51 which cooperates with a corresponding mounting stud for releasably securing frame 20 to glass panel 11.

Turning our attention to FIG. 3, expansion bracket 40 comprises a first layer of metal 41 having a relatively low coefficient of expansion superimposed upon a second layer of metal 42 having a relatively high coefficient of expansion. The gap between vertical leg 45 of expansion bracket 40, and sidewalls 21 of frame 20 is maintained, notwithstanding small variations in the dimensions of the frame.

Looking at FIG. 4, shadow mask 30 includes a plurality of apertures 32 and a narrow lip 31, extending rearwardly from its periphery. As explained later, lip 31 overslips sidewalls 21 of frame 20 and is welded thereto.

Figure 5:
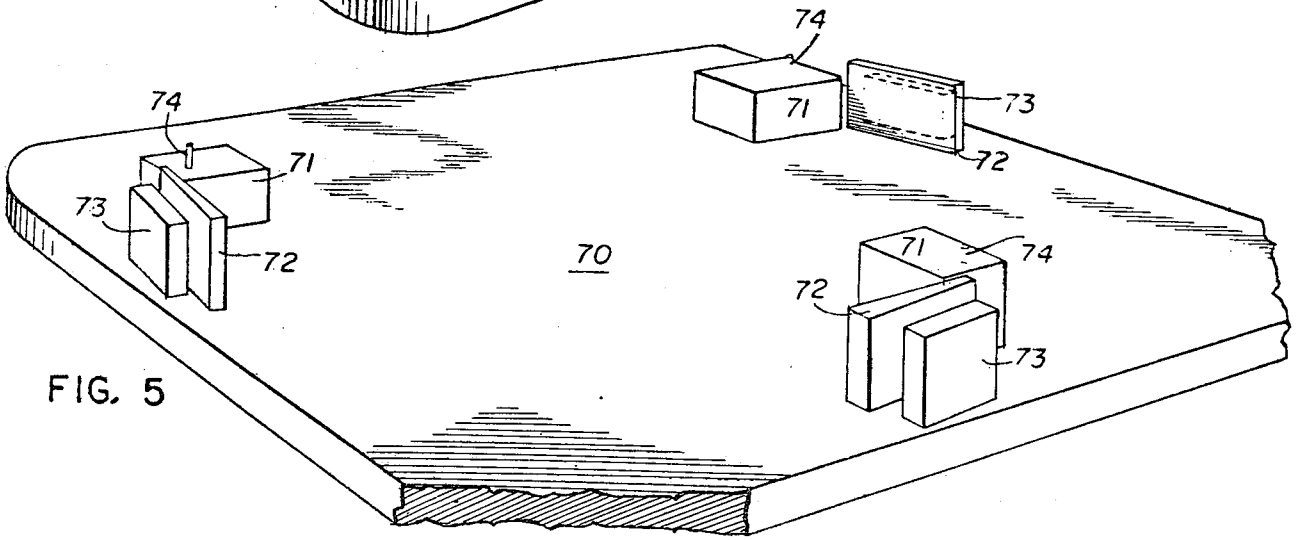
FIG. 5 is a perspective view of assembly apparatus for accurately locating and securing the expansion brackets to the shadow mask frame of the picture tube.

As shown in FIG. 5, an assembly apparatus 70 includes three welding blocks 71, each having a vertically oriented locating pin 74. The relative position of locating pins 74 corresponds to the relative position of locating holes 23. Three adjustable fixtures, each having a pair of leaf spring locating blocks 72 and 73, are accurately positioned with respect to mounting pins 74 such that the undeflected positions of leaf spring 50 are equally displaced from mounting studs 14 (not shown).

Referring now to FIG. 6, frame 20 is shown in place in assembly apparatus 70. Locating pins 74, in cooperation with locating holes 23 and the flat, upper surfaces of welding blocks 71, align the frame in the assembly apparatus. Locating holes 44 of expansion brackets 40 are aligned with locating holes 23 by placing subassemblies 60 over locating pins 74 with vertical legs 45 of the expansion brackets overhanging sidewalls 21 of frame 20. Subassemblies 60 are rotated about locating pins 74 until leaf spring 50 are oriented between locating blocks 72 and 73 and then dropped into position. Three welding electrode means 77, positioned above locating blocks 71, are operated by means not shown, to secure, by welding, the expansion brackets to the frame.

Shadow mask 30 is later secured to frame 20 by slipping its lip 31 over the sidewalls of the frame. Two curvilinear fixtures (not shown) adjust the mask on the frame such that the mask surface is a predetermined distance from faceplate 12. Fixtures of this sort are common in the art for providing what is colloquially called "Q " spacing. The shadow mask is spot welded to the frame along lip 31 and the completed mask-frame assembly may then be fastened to glass panel 11 by deflecting leaf springs 50 and slipping them over mounting studs 14 to provide a stable three point suspension.

Mosaic 19 is deposited by slurrying a light-sensitive emulsion containing phosphor powder of a particular color, red, for example, on the interior of faceplate 12, drying the emulsion and exposing the faceplate to a light source using the apertured shadow mask as a negative. The light beams passing through the individual apertures, strike the emulsion, causing the red phosphor powder to adhere to the faceplate. The unexposed portion of the emulsion is then washed off, leaving red phosphor dots only in the areas exposed to the light. This process is then repeated two additional times with the light source occupying the relative positions of the other electron sources to produce the blue and green phosphor dot structures. Ultimately, glass funnel 15 is frit sealed to the sidewalls of the glass panel, and electron gun 17 is accurately positioned therein.

During picture tube operation, electron bombardment of the shadow mask causes the mask-frame assembly to heat up. As the temperature rises, the assembly expands, and apertures 32 are effectively displaced toward the periphery of the frame. However, expansion brackets 40 also expand, thereby moving the shadow mask closer to the faceplate. As a result, alignment between the electron source and the color phosphors is maintained, and misregistration due to mask movement with temperature changes is limted to an acceptable amount.

As previously mentioned, locating holes 23 are positioned on frame 20 independently of small variations in the dimensions of the frame, that is, the distances between the geometric center and periphery of the frame. Punching means (not shown), comprising three triangularly arranged punching dies, are positioned at the geometric center of a frame-supporting fixture (also not shown). The relative position of the punching dies corresponds exactly to the positions of locating holes 44 of expansion brackets 40, and is mathematically predetermined by the location of the mounting studs, the length and attitude of the leaf springs and the dimensions of the expansion brackets. Thus, locating holes 23 are accurately punched in the frame by the punching dies independent of minor dimension variations of the frame.

As discussed in the description of FIG. 3, vertical leg 45 of expaansion bracket 40 always overhangs sidewalls 21, in spite of small frame dimensional variations. This is accomplished by making horizontal leg 43 long enough to compensate for the largest permissible deviation in frame 20, which insures sufficient clearance between vertical leg 45 and sidewall 21 to allow unrestrained flexure of the expansion bracket.

As previously mentioned, both horizontal leg 43 of expansion bracket 40, and top surface 22 of frame 20 are substantially flat, thus making for good distortionless contact when the surfaces are welded. Hence, the possibility of developing stresses in these parts during welding is minimized. An abrupt bend in horizontal leg 43 is provided as a further safeguard in avoiding any surface irregularities near the edge of the frame.

Positioning locating holes 23 on the top surface of the frame, independently of the variations in the dimensions thereof, permits frame 20 and subassemblies 60 to be properly positioned over locating pins 74. The undeflected positions of leaf springs 50 are properly set by locating blocks 72 and 73 which will insure equal deflection (hence loading) when the springs are engaged with mounting studs 14, even though the spring configurations may differ from each other (that is, evven though the angles the springs make with their respective expansion bracket vertical legs differ). This alignment technique insures uniform deflection of the springs when the mask-frame assembly is fastened to the glass panel and precludes lateral shifting of the mask-frame assembly upon heating.

Assuming that the leaf springs were not properly aligned, one spring would of necessity be deflected more than the others when the frame is fastened to the panel, and consequently, noniuniform forces are applied, through the expansion brackets, to the frame. During fabrication, when the picture tube is subjected to substantial increases in temperature, these forces would tend to relieve themselves, causing the mask-frame assembly to skew with respect to the glass panel. This movement would upset the alignment between the shadow mask and the color phosphors and cause misregistration. Skewing or lateral shifting of the mask with temperature is extremely difficult to correct and consequently, all efforts are made to minimize this source of misregistration.

Additionally, Applicants have provided means for adjusting leaf spring locating blocks 72 and 73 to compensate for situations where a batch of panels may have a misplaced mounting stud. These may be readily detected by the operator since it is necessary to displace the frame laterally when attempting to engage the last spring on the last mounting stud. If a run of such panels is received, some or all of the locating blocks 72 and 73 may be displaced to reorient subassemblies 60 about locating holes 23 in a manner to assure equal loading on the springs when the mask-frame assembly is mounted in the panel. Naturally, such a change would only be made when a substantial number of such panels were encountered.

What has been described is a novel means for providing thermal compensation in color television picture tubes. It is obvious that upon study by those skilled in the art, the disclosed embodiments may be altered without departing from the essence of the invention. Accordingly, the scope of protection to be given to this invention should not be limited by the embodiments described above but should be determined by the descriptions which appear in the appended claims.

We claim:

1. A color television tube comprising: a glass panel having a discrete pattern of color phosphor elements thereon; a plurality of mounting studs disposed about the interior of said panel; an aperture mask having a radial axis of symmetry passing through a central portion thereof, said central portion being aligned in a predetermined position with respect to the phosphor pattern; a relatively rigid frame comprising a base flange and edge flange supporting said mask, said frame having a number of locating characters defining a plurality of first locating holes on said base flange, said first locating holes being accurately positioned with respect to said mounting studs; a corresponding plurality of spring members circumferentially disposed about said frame, cooperating with said mounting studs, for releasably maintaining said aperture mask in registry with said phosphor elements; and a plurality of substantially L-shaped thermal expansion members, each having a first leg secured to a respective one of said spring members, and a second leg secured to said frame and having a second locating hole respectively aligned with said first locating holes, whereby said expansion members may be accurately positioned on said base flange of said frame; said thermal expansion members comprising a bimetallic body with a first layer having a relatively high coefficient of thermal expansion and a second layer having a relatively low coefficient of thermal expansion whereby said expansion members undergo corrective flexures as said mask expands and contracts over the operating temperature range of said picture tube to maintain proper registration between said aperture mask and said phosphor elements.

2. The combination as set forth in claim 3, wherein said base flange is substantially flat and said second leg of each of said expansion members overlies said base flange, whereby said first leg extends parallel to said edge flange and is displaced therefrom a distance at least as great as the permissible variation in the dimension defined by the distance between the geometric center and the perimeter of said frame.

3. The combination as set forth in claim 2, wherein said second leg of said expansion member includes an abrupt bend, whereby surface irregularities in said base flange near the junction of said edge flange do not interfere with proper seating of said expansion member on said frame.

4. In a color television picture tube the combination of: a glass panel having a discrete pattern of color phosphor triads superimposed thereon; an aperture mask supported near said screen in registration with said phosphor triads, said aperture mask having a radial axis of symmetry passing through a central portion thereof, said central portion being aligned in a predetermined position with respect to the phosphor pattern; three mounting studs disposed about the interior of said panel; a rigid frame having a substantially L-shaped cross-section supporting said aperture mask; said frame comprising an edge member and a substantially flat base member having three first locating holes accurately positioned with reference to said mounting studs; three substantially L-shaped bimetallic expansion members each comprising a first layer of material having a relatively high coefficient of thermal expansion and a second layer of material having a relatively low coefficient of thermal expansion; each of said expansion members further including a first leg, and a second leg having a second hole; said second leg of each of said expansion members being secured to said base member of said frame with said second locating hole aligned with said first locating hole; said second leg of said expansion member overlying said base member of said frame and having an abrupt bend; said first leg of said expansion member extending parallel to said edge member of said frame and being displaced therefrom a distance at least as great as the permissible variation in the dimension defined by the distance between the geometric center and perimeter of said frame; three leaf springs secured respectively to said first legs of said expansion members; each of said springs being respectively secured to one of said mounting studs for releasably maintaining said aperture mask in registry with said phosphor triads, whereby said registration is substantially maintained over the operating temperature range of said picture tube.

5. In a cathode ray tube including an enclosing envelope and a faceplate panel having a discrete pattern of light emitting phosphors thereon, the combination of apertured beam masking means having a radial axis of symmetry passing through a central portion thereof, mask support means fixed with respect to the tube envelope, mounting means including a pair of mounting members on opposite radial sides of said masking means, connecting means including a pair of L-shaped bimetallic strips each having a foot portion and a leg portion, said leg portion having a part thereof connected to said beam masking means and an unconnected part, said leg portion being connected to said masking means to space said foot portion a given distance from said masking means, each said mounting member extending between respective foot portions of said bimetallic strips and said mask support means to suspend said masking means with the central portion thereof aligned in a predetermined position with respect to the phosphor pattern, said given distance of said foot portion from said masking means being selected such that said mounting members each join said L-shaped bimetallic strips at respective predetermined angles with said masking means and extend substantially transverse to the radial axis of symmetry thereof, said masking means being of a construction such that a thermal responsive dimensional change takes place therein substantially parallel to the radial axis tending to cause a first shift of said central portion of said masking means about said mask support means engaged by each of said mounting members in a direction substantially normal to the radial axis and in an amount determined by said predetermined angles, said mounting members each tending to cause a predeterminable second shift of said central portion of said masking means substantially normal to the radial axis by an amount dependent on the thermal coefficient of expansion of said mounting members, said mounting members being connected at a junction point to said masking means by said bimetallic strips at a given distance from the radial axis, said given distance encompassing a portion of said masking means having a thermal responsive dimensional change tending to cause a third predeterminable shift of said central portion of said masking means substantially normal to the radial axis, at least one of said first, second and third shifts associated with each of said mounting members being in the opposite direction from another therof, and said predetermined angles, said thermal coefficient of expansion of each said mounting member, and said given distance from the radial axis to the junction point of each of said mounting members with said masking means being selected so that said shifts in opposite directions from one another compensate each other thereby maintaining the central portion of said masking means in substantially the same predetermined position with respect to the phosphor pattern, and said unconnected parts of each said leg portion of said L-shaped bimetallic strips pull away from said masking means with temperature change to move the same closer to the faceplate panel to compensate for the radial expansion of the non-central portion of the masking device.

6. In a cathode ray tube including an enclosing envelope, a front panel having a discrete pattern of light emitting phosphors thereon, and an apertured beam masking device having a radial axis of symmetry passing through a central portion thereof and being suspended in the tube by at least three cantilever mounting springs secured to the masking device in different quadrants and connected to respective studs mounted in the tube envelope adjacent the screen, with the central portion aligned in a predetermined position with respect to the phosphor pattern, the combination including, first and second L-shaped bimetallic strips each having a leg portion and a foot portion, each said leg portion being connected through its higher thermal expansion coefficient element to the masking device at a given angle in opposite quadrants thereof, said leg portions being connected so said foot portions extend from the masking device at a predetermined distance, first and second cantilever springs being connected to said foot portions and extending upwardly from the masking device to the respective studs transverse to the radial axis of symmetry of the masking device, said predetermined distance of each said foot portion from said masking device being selected such that each said spring forms a predeterined angle with said masking device whereby thermal responsive dimensional change of the masking device whereby thermal responsive dimensional change of the masking device plus the dimensional change of said foot portions of said bimetallic strip in a direction parallel to the radial axis of symmetry causes the central portion of the masking device to move in one direction normal to the radial axis of symmetry an amount depending on said predetermined angle, said angle being selected so that the movement in said one direction is substantially eqal to the thermal responsive dimensional change of the masking device between the stud mounting point and said radial axis of symmetry in a direction normal thereto and opposite in direction to said one direction thereby maintaining the central portion of the masking device in substantially the same predetermined position with respect to the phosphor pattern, and the thermal responsive dimensional change of said leg portions of said bimetallic strips changes the given angle each of said leg portions makes with the masking device to move the masking device closer to the front panel thereby compensating for the radial expansion of the non-central portion of the masking device.

* * * * *